US007530289B2

(12) United States Patent
Willemsen et al.

(10) Patent No.: US 7,530,289 B2
(45) Date of Patent: May 12, 2009

(54) MANUAL ADJUSTABLE PEDAL ASSEMBLY

(75) Inventors: Larry G. Willemsen, Morpeth (CA); Daniel O'Neill, Chatham (CA)

(73) Assignee: KSR Technologies Co., Ridgetown (CA)

( * ) Notice: Subject to any disclaimer, the term of this patent is extended or adjusted under 35 U.S.C. 154(b) by 594 days.

(21) Appl. No.: 11/038,879

(22) Filed: Jan. 20, 2005

(65) Prior Publication Data

US 2005/0160869 A1 Jul. 28, 2005

Related U.S. Application Data

(60) Provisional application No. 60/538,649, filed on Jan. 23, 2004.

(51) Int. Cl.
*G05G 1/14* (2006.01)

(52) U.S. Cl. ..... 74/512; 74/513

(58) Field of Classification Search ..... 74/512–514, 74/560

See application file for complete search history.

(56) References Cited

U.S. PATENT DOCUMENTS

| | | | | | |
|---|---|---|---|---|---|
| 3,631,739 | A | * | 1/1972 | McArthur | 74/513 |
| 4,165,901 | A | * | 8/1979 | Swenson et al. | 297/411.33 |
| 4,353,443 | A | * | 10/1982 | Lombardo | 477/193 |
| 4,470,570 | A | | 9/1984 | Sakurai et al. | 244/235 |
| 4,528,590 | A | | 7/1985 | Bisacquino et al. | 338/153 |
| 4,883,037 | A | | 11/1989 | Mabee et al. | 123/399 |
| 4,915,075 | A | | 4/1990 | Brown | 123/399 |
| 4,938,304 | A | | 7/1990 | Yamaguchi et al. | 180/197 |
| 4,958,607 | A | | 9/1990 | Lundberg | 123/399 |
| 4,969,437 | A | | 11/1990 | Kolb | 123/399 |
| 4,986,238 | A | | 1/1991 | Terazawa | 123/361 |
| 5,056,742 | A | | 10/1991 | Sakurai | 244/235 |
| 5,063,811 | A | | 11/1991 | Smith et al. | 74/513 |
| 5,215,057 | A | | 6/1993 | Sato et al. | 123/400 |
| 5,233,882 | A | | 8/1993 | Byram et al. | 74/514 |
| 5,241,936 | A | | 9/1993 | Byler et al. | 123/399 |
| 5,385,068 | A | | 1/1995 | White et al. | 74/512 |
| 5,460,061 | A | | 10/1995 | Redding et al. | 74/512 |
| 5,632,183 | A | | 5/1997 | Rixon et al. | 74/512 |
| 5,676,220 | A | * | 10/1997 | Dapsi et al. | 180/334 |
| 5,771,752 | A | | 6/1998 | Cicotte | 74/512 |
| 5,819,593 | A | | 10/1998 | Rixon et al. | 74/514 |
| 5,887,488 | A | | 3/1999 | Riggle | 74/514 |

(Continued)

*Primary Examiner*—Richard W L Ridley
*Assistant Examiner*—Thomas Diaz
(74) *Attorney, Agent, or Firm*—Gifford, Krass, Sprinkle, Anderson & Citkowski, P.C.

(57) ABSTRACT

A manual adjustable pedal assembly includes a throttle pedal assembly having a throttle pedal adjustment mechanism and a brake pedal assembly having a brake pedal adjustment mechanism. The manual adjustable pedal assembly also includes a manual adjusting means having a rotatable adjustment means, an outer ring gear disposed in a center portion of the rotatable adjustment means, and a first inner gear and a second inner gear operatively in communication with the outer ring gear. The manual adjustable pedal assembly further includes a throttle drive cable, wherein one end of the throttle drive cable is operatively secured to the first inner gear, and the other end of the drive cable is secured to the throttle adjustment mechanism. The manual adjustable pedal assembly still further includes a brake drive cable, wherein one end of the brake drive cable is operatively secured to the second inner gear, and the other end of the drive cable is secured to the brake adjustment mechanism, for simultaneous adjustment of both the brake pedal and the throttle pedal.

12 Claims, 12 Drawing Sheets

U.S. PATENT DOCUMENTS

| | | | | |
|---|---|---|---|---|
| 5,927,154 | A | 7/1999 | Elton et al. | 74/512 |
| 6,019,015 | A | 2/2000 | Elton | 74/513 |
| 6,019,241 | A | 2/2000 | Burns | 220/570 |
| 6,073,515 | A | 6/2000 | Elton et al. | 74/564 |
| 6,151,986 | A | 11/2000 | Willemsen et al. | 74/512 |
| 6,173,625 | B1 | 1/2001 | McFarlane et al. | 74/512 |
| 6,178,847 | B1 | 1/2001 | Willemsen et al. | 74/512 |
| 6,289,763 | B1 | 9/2001 | Rixon et al. | 74/514 |
| 6,293,584 | B1 * | 9/2001 | Levine | 280/735 |
| 6,305,239 | B1 | 10/2001 | Johansson et al. | 74/512 |
| 6,321,617 | B1 | 11/2001 | Schwyn | 74/512 |
| 6,374,695 | B1 | 4/2002 | Johansson et al. | 74/512 |
| 6,389,927 | B1 | 5/2002 | Willemsen | 74/514 |
| 6,584,871 | B2 | 7/2003 | Burton et al. | 74/512 |
| 6,655,231 | B2 | 12/2003 | Willemsen | 74/512 |
| 6,792,827 | B2 | 9/2004 | Willemsen | 74/512 |

* cited by examiner

MANUAL ADJUSTABLE PEDAL ASSEMBLY

RELATED APPLICATION

This application claims priority of U.S. Provisional Patent Application Ser. No. 60/538,649 filed Jan. 23, 2004, which is incorporated herein by reference.

BACKGROUND OF THE INVENTION

1. Field of the Invention

The present invention relates generally to pedal assemblies for throttle and brake systems in vehicles, and more particularly, to an adjustable pedal assembly with a manual adjustment device.

2. Description of the Related Art

Vehicles, and in particular automotive vehicles, utilize a foot-operated device, such as a brake pedal or a throttle control pedal, also referred to as an accelerator pedal, to control the movement of the vehicle. Conventional brake systems include a brake pedal for transmitting a braking force from the vehicle operator to the wheels of the vehicle. Similarly, conventional throttle control systems include a throttle pedal to transmit a signal from the vehicle operator to a throttle controller to control acceleration and movement of the vehicle. In the past, the signal from either the brake pedal or throttle pedal was transmitted mechanically. Recent innovations in electronics technology have led to increased use of electronic controls for the throttle system or the brake system. In an electronically controlled throttle control system, the pedal arm is attached to a position sensor, which senses the relative position of the pedal arm and transmits a signal to a controller to operate the throttle. The electronically controlled brake system operates in a similar manner.

Typically, the brake and throttle pedals are aligned in a predetermined dimensional relationship relative to each other and fixed portions of the vehicle, including the vehicle dash panel, floor, seat and instrument panel. The pedal pad portion of the pedal assembly travels in a predetermined path. In the past, the path was typically an arc.

The pedals are positioned in the vehicle so that they are accessible by the driver. However, drivers come in a wide variety of shapes and sizes, and a pedal positioned to accommodate a large driver with a large foot will generally be unreachable by a small driver with a small foot. Previously, the pedals were fixedly positioned, so that the majority of drivers were accommodated, from a functional and ergonomic aspect. An example of a functional aspect of the pedal is the ability of the driver to reach and actuate the pedal. An example of an ergonomic aspect of the pedal is the driver's comfort while actuating the pedal, as measured by subjective parameters as well as objective parameters, such as foot angle.

More recently, adjustable pedals have been used in vehicles to accommodate a greater number of drivers from a functional and ergonomic perspective. With an adjustable pedal, the driver activates a switch to modify the position of the pedal so that it is either closer to the driver or away from the driver. At the same time, it is essential that the relative dimensional relationships between the pedals be maintained during adjustment, such as the height relationship between each of the pedals.

An example of such an adjustable pedal is disclosed in commonly assigned U.S. Pat. No. 6,151,986 to KSR International, Inc. entitled "Adjustable Vehicle Control Pedals," the disclosure of which is incorporated herein by reference. This type of adjustable pedal works well, and includes an adjustment mechanism comprising a motor, a drive mechanism operatively connected to the motor and a screw mechanism operatively connected to the pedal.

Another example of an adjustable control vehicle pedal is disclosed in U.S. Pat. No. 6,389,927. The patent discloses a control pedal arrangement including a base member having an integral support arm for supporting a pedal arm. The base also has a guide device and control mechanism for adjusting the position of the pedal arm. The control mechanism includes a motor with a gear for driving a screw rod. The screw rod extends between the base and the pedal arm and pivotally adjusts the position of the pedal arm with respect to the operator. In operation, as the pedal arm is pivoted about a pivot axis, the pedal pad moves through an arc which raises the pedal pad as it moves into the vehicle.

In the previously described systems, the driver activates a power operated switch to send an electronic signal to the brake pedal and the throttle pedal systems to adjust the respective pedals. The signal is transmitted to a motor operatively connected to a screw mechanism, which adjusts the pedal. While this system works well, it is expensive due to the cost of the motor. Thus, there is a need in the art for a cost effective adjustable pedal assembly that mechanically controls the position of the pedal pad with respect to the driver during adjustment of the pedal assembly.

SUMMARY OF THE INVENTION

Accordingly, a manual adjustable pedal assembly is provided. The manual adjustable pedal assembly includes a throttle pedal assembly having a throttle pedal adjustment mechanism, and a brake pedal assembly having a brake pedal adjustment mechanism. The manual adjustable pedal assembly also includes a manual adjusting means having a support bracket, and a rotatable adjustment means supported by the adjusting means support bracket. An outer ring gear is disposed in a center portion of the rotatable adjustment means, a gear support member is operatively secured to the support bracket, and a first inner gear and a second inner gear are supported by the gear support member and operatively in communication with the outer ring gear. The manual adjustable pedal assembly further includes a throttle drive cable, and one end of the throttle drive cable is operatively secured to the first inner gear, and the other end of the drive cable is secured to the throttle adjustment mechanism, for transmitting the rotary motion of the rotatable adjustment means to the throttle pedal adjusting means. The manual adjustable pedal assembly still further includes a brake drive cable, and one end of the brake drive cable is operatively secured to the second inner gear, and the other end of the drive cable is secured to the brake adjustment mechanism, for transmitting the rotary motion of the rotatable adjustment means to the brake pedal adjusting means for simultaneous adjustment of the brake pedal and the throttle pedal.

One advantage of the present invention is that a pedal assembly is provided that is manually adjusted. Another advantage of the present invention is that a manual adjustable pedal assembly is provided with a pedal pad that can be ergonomically positioned to accommodate a variety of drivers while retaining the functional features of the pedal assembly. Still another advantage of the present invention is that the manual adjustable pedal transmits a mechanical signal from the driver actuated switch to the throttle and brake pedals. Still yet another advantage of the present invention is that fewer components are utilized with respect to an electronically transmitted signal, to enhance packageability within the interior environment of the vehicle. A further advantage of the present invention is that the manual adjustable pedal is cost effective to manufacture.

Other features and advantages of the present invention will be readily appreciated, as the same becomes better understood after reading the subsequent description taken in conjunction with the accompanying drawings.

DETAILED DESCRIPTION OF THE INVENTION

Figure 1:
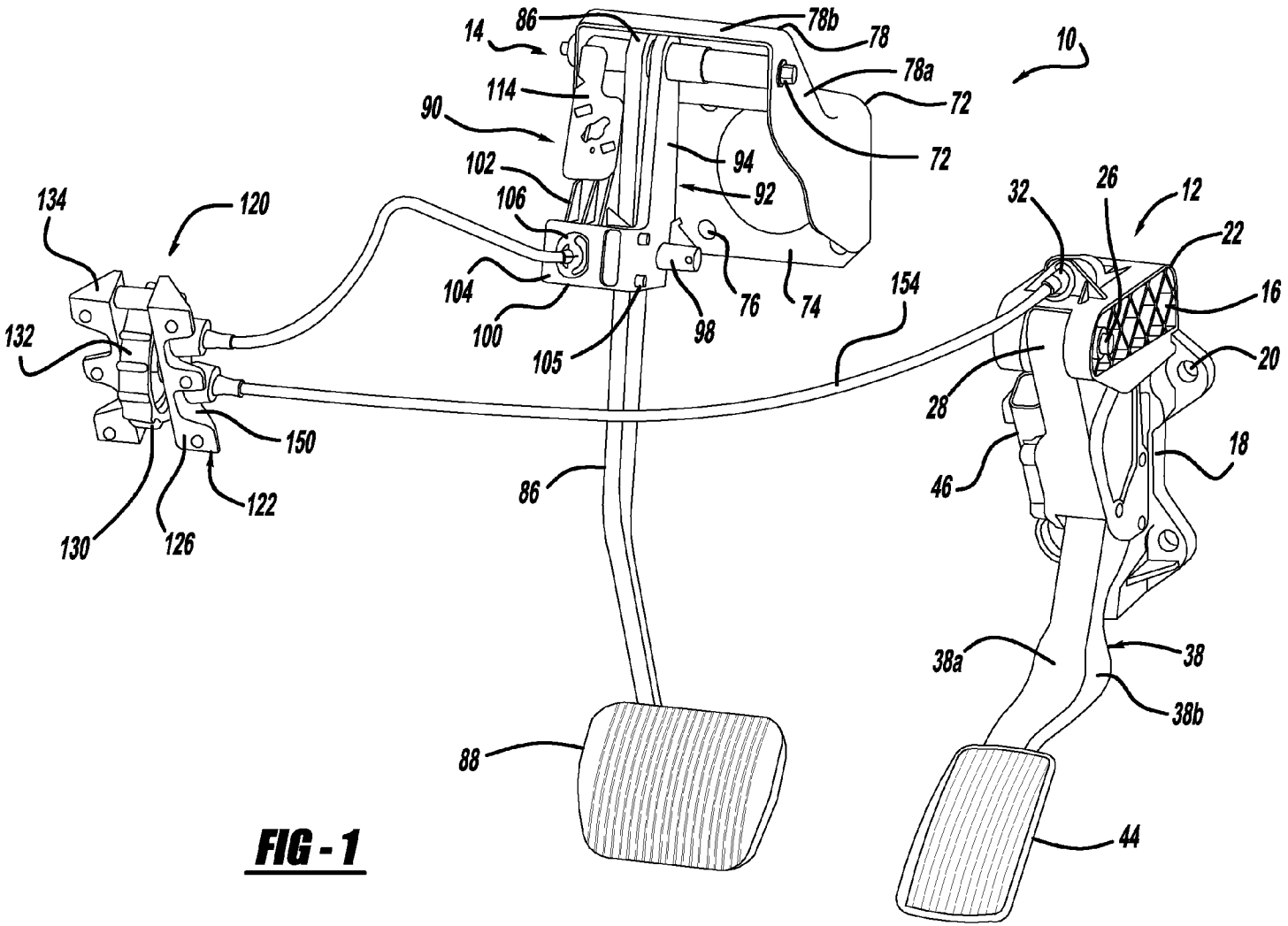
FIG. 1 is a perspective view of the manual adjustable pedal assembly, according to the present invention.
Figure 2:
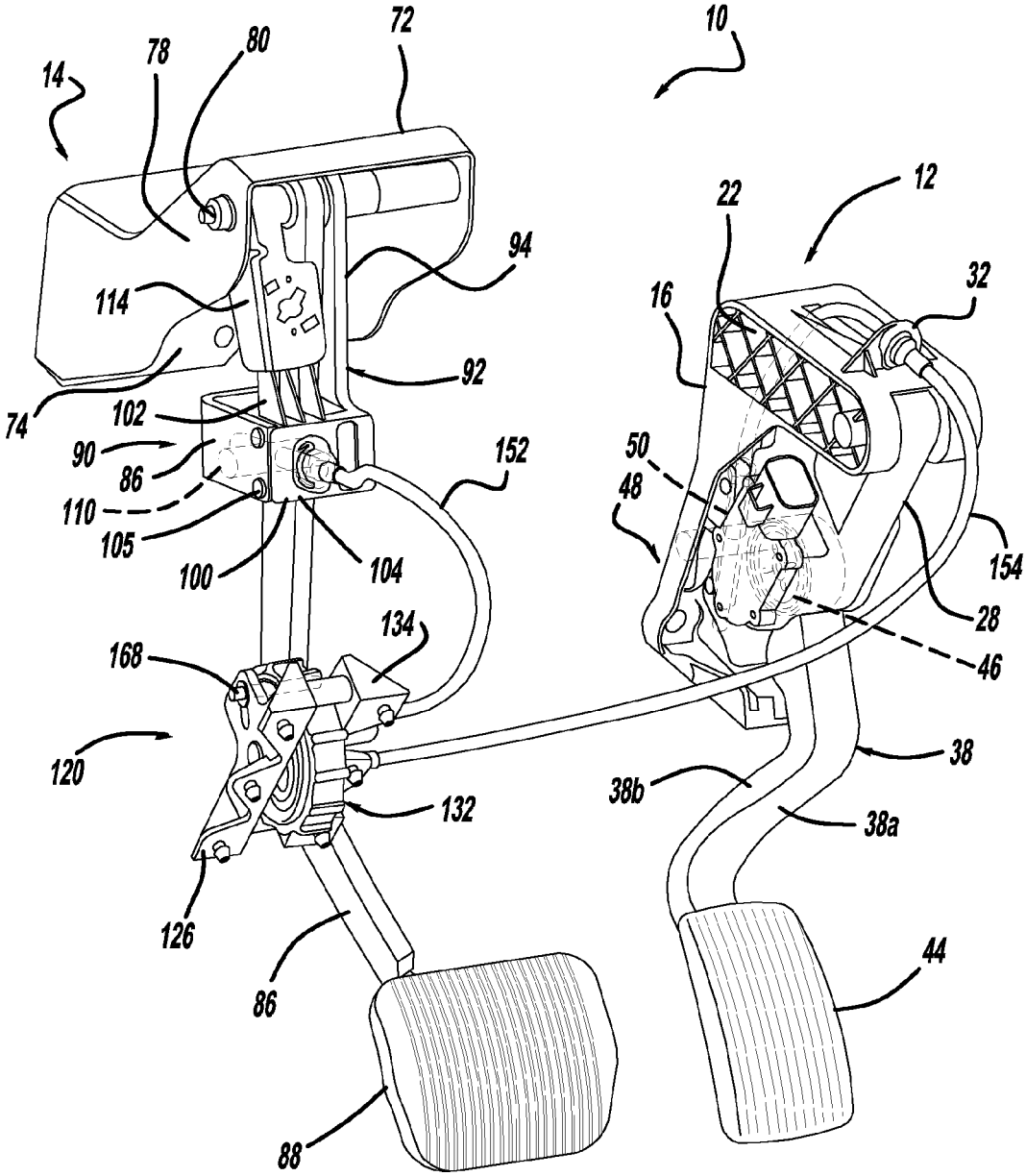
FIG. 2 is another perspective view of the manual adjustable pedal assembly, according to the present invention.
Figure 3:
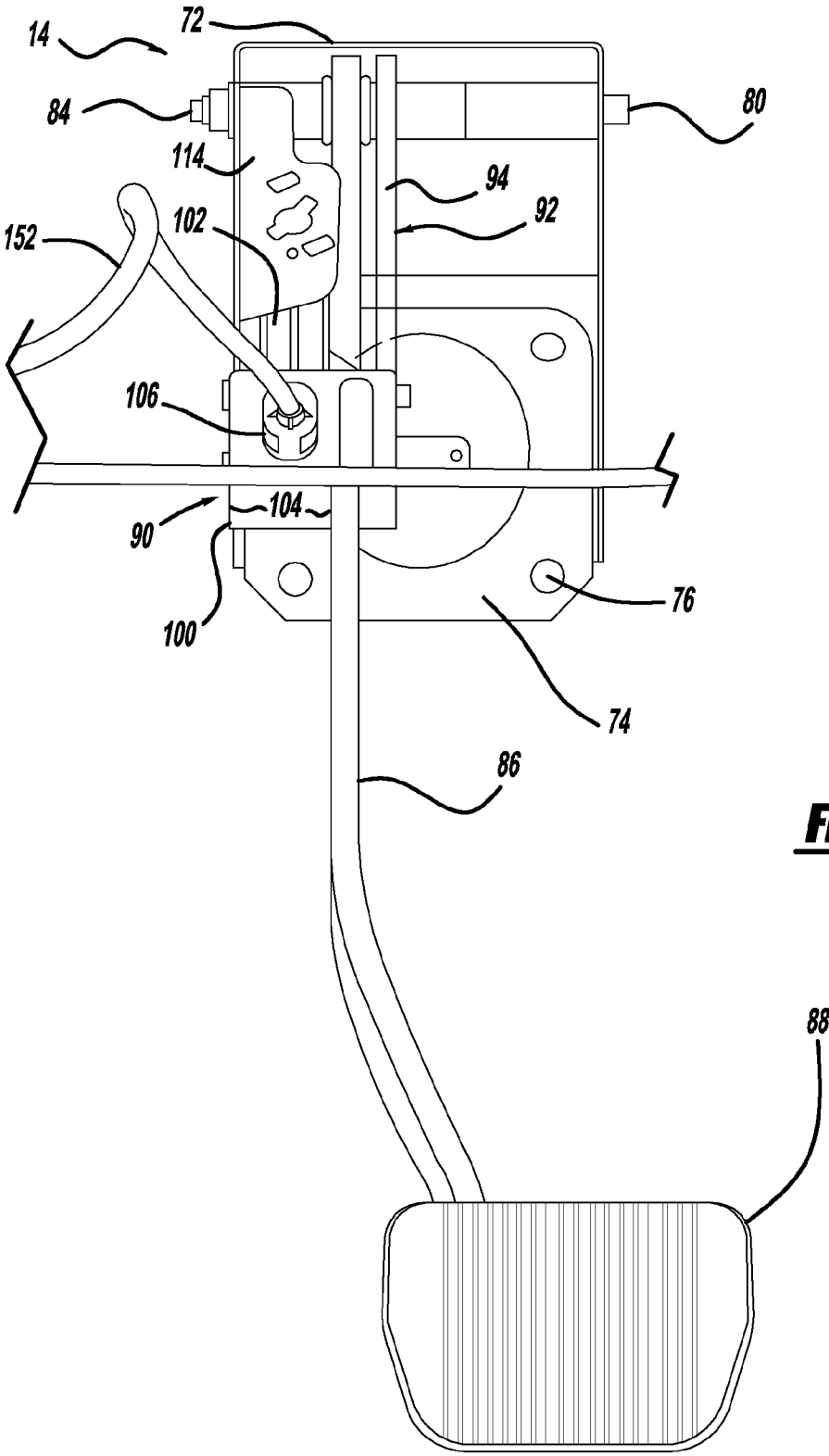
FIG. 3 is an elevational view of the brake pedal for the manual adjustable pedal assembly of FIG. 1, according to the present invention.
Figure 4:
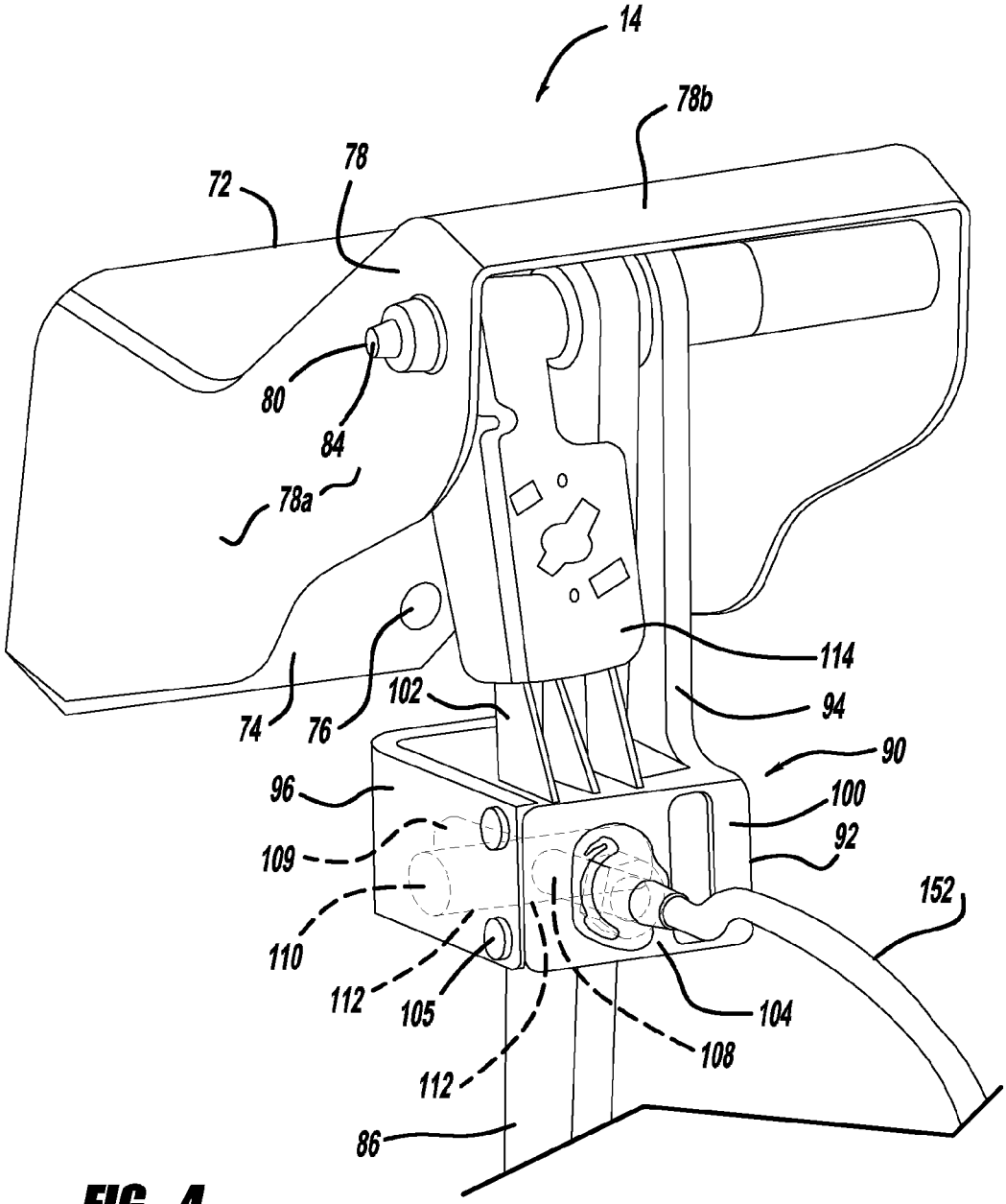
FIG. 4 is an elevational view of the adjustment mechanism for the brake pedal of FIG. 1, according to the present invention.
Figure 5:
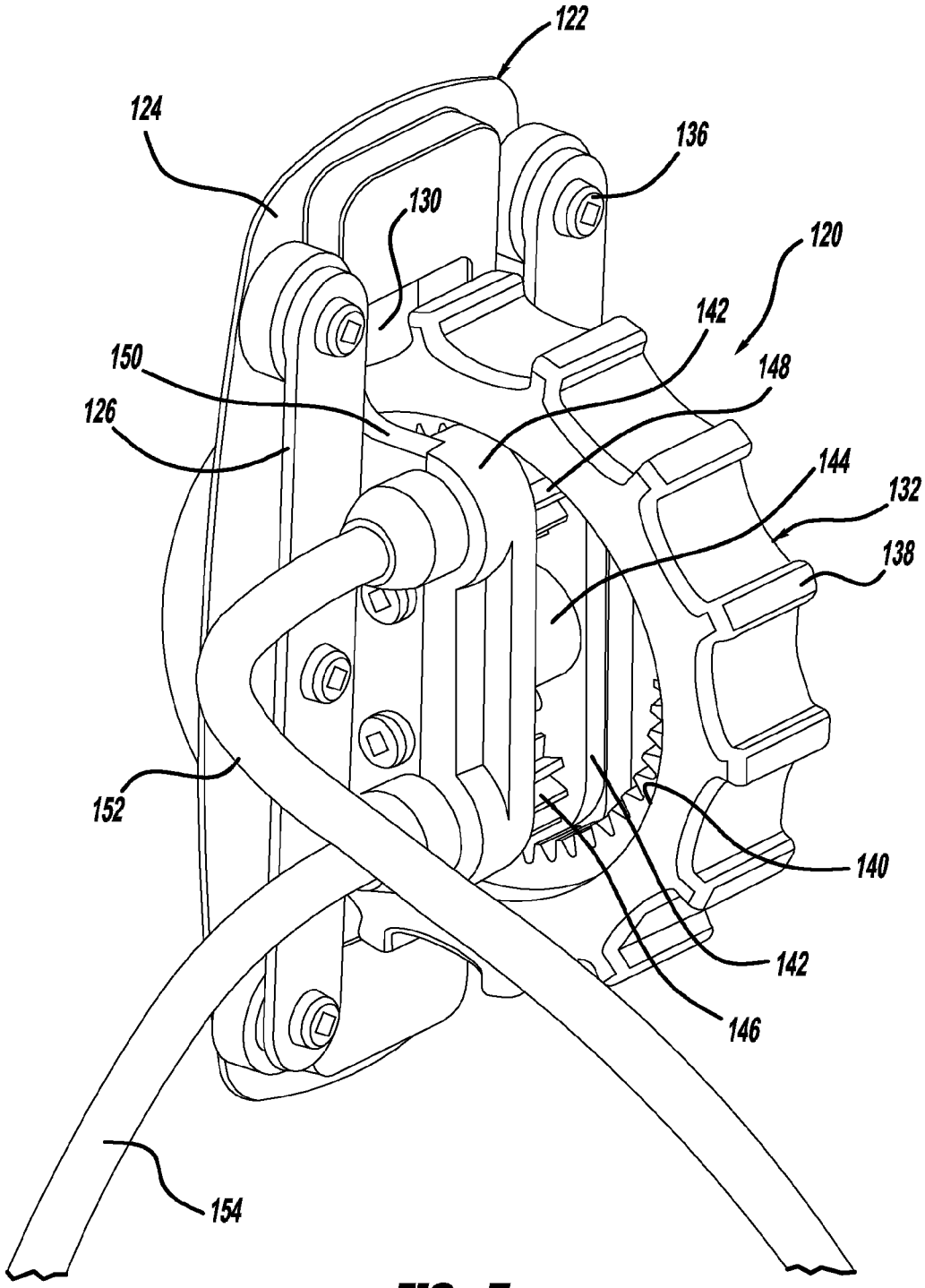
FIG. 5 is a perspective view of the manual adjustment mechanism for the manual adjustable pedal assembly of FIG. 1, according to the present invention.
Figure 6:
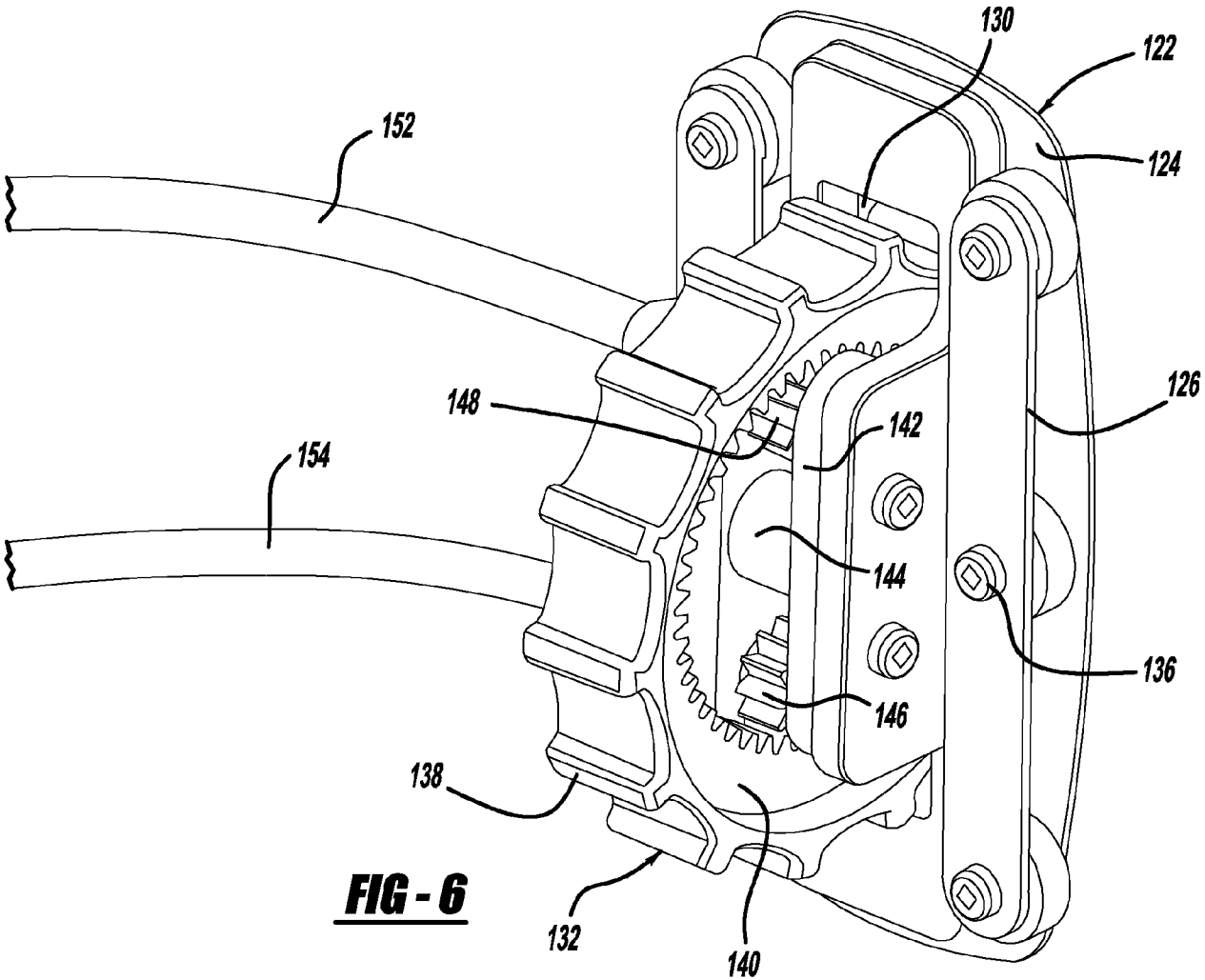
FIG. 6 is a perspective view of an opposite side of the manual adjustment mechanism for the manual adjustable pedal assembly of FIG. 1, according to the present invention.

Referring to FIGS. 1-11, a manual adjustable pedal assembly 10 is illustrated. It should be appreciated that in this example a throttle pedal 12 and a brake pedal 14 are described, although other combinations of pedals are contemplated, such as the inclusion of a clutch pedal (not shown), or the like.

The throttle pedal 12 of this example is an electronic throttle control pedal which transmits a signal from the driver to a throttle controller (not shown) in order to control movement of the vehicle. Similarly, the brake pedal 14 is an electronically controlled brake pedal, which transmits a signal from the driver through the brake pedal assembly 14 to a braking mechanism (not shown) in order to control movement of the vehicle.

The throttle pedal assembly 12 includes a mounting bracket 16, or mounting base, for attaching the pedal assembly to a portion of the vehicle. The mounting bracket 16 includes a generally planar mounting face 18. In this example, the mounting bracket 16 is attached to the dash panel using a fastening means (not shown), such as a bolt or the like. The mounting face 18 includes at least one aperture 20 for receiving the attaching means. The mounting bracket 16 includes an outwardly extending surface 32 having a mounting aperture 34 for receiving the throttle drive cable 154, to be described.

The mounting bracket 16 also includes a pair of upper arms 22 extending radially from an upper end of the mounting face, such that the arms 22 oppose each other. The mounting bracket 16 has a generally inverted "L" shape. Each of the upper arms 22 includes an aperture 24 located near an outer end for receiving a swing arm mounting means 26. The mounting bracket upper arms 22 pivotally support a swing plate 28 disposed on the swing arm mounting means 26. In this example, the swing arm mounting means 26 is a pivot pin for pivotally supporting the swing plate 28 between the mounting bracket upper arms 22 at a first fixed pivot axis, shown at 30.

The swing plate 28 is used to adjust the position of the pedal arm. The swing plate 28 is a generally planar member having an elongated shape. An upper end of the swing plate 28 is pivotally supported between the support bracket upper arms 22 at the first fixed pivot point 30. The upper end of the swing plate includes an aperture for receiving the swing arm mounting means. A lower end of the swing plate 28 provides a support for the adjustment means, in a manner to be described. It should be appreciated that the swing plate may be adapted to support other components related to the throttle pedal assembly.

The throttle pedal assembly 12 also includes a pedal support arm 38. An upper end of the pedal support arm 38 is pivotally attached to the swing plate 28 at a second non-fixed pivot axis, as shown at 40. It should be appreciated that the second pivot axis 40 is positioned below the first pivot axis 30. This arrangement allows for integral movement of the swing plate 28 and pedal arm 38 about the first pivot axis 30 when the pedal is adjusted. In this example, the pedal arm 38 is an elongated member having a front face portion 38*a*, and side portions 38*b* extending from an edge of the face portion. An upper end of the pedal arm 38 includes an aperture for pivotally securing the pedal arm 38 to the swing plate 28, such as by a pivot pin or the like. A pedal pad 44 is fixedly secured to a lower end of the pedal arm 38. In this example, the pedal pad 44 is a rectangular member made from an isomeric material, such as rubber.

In this example, the throttle pedal assembly 12 is an electronically controlled throttle assembly, as is known in the art. The electronically controlled throttle control assembly includes an electronic position sensing device 46 mounted to the swing plate 28, and centered at the second, non-fixed pivot axis 40. An example of an electronic sensing device 46 is a position sensor, potentiometer, inductive sensor, Hall sensor or the like. Movement of the pedal arm 38 about the second non-fixed pivot axis 40 produces an electronic control signal proportional to the position of the pedal arm 38. This signal is transmitted to a controller and used to operate the corresponding throttle control, to ultimately vary the speed of the vehicle.

The throttle pedal assembly 12 further includes a throttle pedal adjustment mechanism 48 for adjusting the relative position of the pedal pad 44 with respect to the driver by modifying the angular relationship between the swing plate 28 and the mounting bracket 16, and the swing plate 28 and the pedal arm 38. The adjustment mechanism 48 includes a trunnion 50. The trunnion 50 includes a housing, with an upper end having a box shape and a lower end having a cylindrical shape. The trunnion 50 also includes a pin 54 extending radially from opposing ends of the box portion to pivotally support the trunnion on the throttle pedal mounting bracket 16.

The adjustment mechanism 48 further includes a screw rod 58 disposed in a sleeve 60, wherein an upper end of the screw rod 58 is operatively attached to a throttle pedal drive cable 154. The adjustment mechanism includes a guide nut 62 slidingly disposed on the screw rod 58, so that the guide nut 62 moves up or down the screw rod 58 depending on the rotation of the screw rod. The guide nut includes a pin 64 extending radially from opposing sides of the guide nut 62 for pivotally supporting the screw rod 58 on the swing plate 28 at a third non-fixed pivot axis, as shown at 66. It should be appreciated that the third pivot axis 66 is positioned below the first pivot axis 30 and the second pivot axis 40.

The other end of the throttle drive cable is attached to a throttle drive means, in a manner to be described. The throttle drive cable includes an outer housing, and a guide wire (not shown) disposed in the housing. Rotation of the guide wire causes a corresponding rotation of the screw rod, and subsequent linear displacement of the guide nut and swing plate, to vary the position of the pedal pad forward or rearward in the vehicle. The pedal is shown in a fully adjusted position in FIG. 11.

It should also be appreciated that the accelerator pedal assembly may also include other components that are known in the art, such as electrical connectors, or the like.

The manual adjustable pedal assembly 10 also includes a brake pedal assembly 14, which is fixedly mounted to a dash panel portion of the vehicle in a conventional position beneath the instrument panel. The brake pedal assembly 14 includes a brake pedal support bracket 72 for attaching the brake pedal assembly 14 to the dash panel. The brake pedal support bracket 72 includes a generally planar mounting face 74. The mounting face 74 includes at least one aperture 76 for attaching the support bracket 72 to the vehicle using an attaching means, such as by bolting or the like.

The brake pedal support bracket 72 also includes an arm 78 extending radially from an upper edge of the mounting face 74. In this example, the arm 78 includes two spaced apart side walls 78*a* joined by an upper wall 78*b*. Each side wall 78*a* provides a mounting surface for pivotally supporting a brake pedal arm at a first fixed brake pedal pivot axis, in a manner to be described.

The brake pedal assembly 14 also includes a cantilever style pedal arm 86. The brake pedal arm 86 is a generally elongated member. An upper end of the brake pedal arm 86 is pivotally supported between the side walls 78*a* of the support bracket 72 via a pivot pin 80 disposed within an aperture in each of the side walls 78*a*. A pedal pad 88, as is known in the art, is mounted to a lower end of the pedal arm 86. The pedal pad 88 provides a pedal actuation point for transmitting the force of the driver's foot contacting the pedal pad 88 to the braking mechanism to control the movement of the vehicle. Preferably, the pedal pad 88 is made from an isomeric material, such as rubber.

The brake pedal assembly further includes a brake pedal adjustment mechanism 90 for adjusting the initial starting position of the brake pedal pad 88. The brake pedal adjustment mechanism 90 includes a first brake pedal adjustment member 92 pivotally supported by the brake pedal support bracket 72 using the pivot pin 80 at the first fixed brake pivot axis, as shown at 84. The brake pedal adjustment member 92 includes a vertically extending, generally planar, first link member 94, and an upper end of the first link member 94 is pivotally mounted on the pivot pin 80. The first brake pedal adjustment member 92 also includes a horizontally oriented, U-shaped, second link member 96 that is integral with the first link member 94. It should be appreciated that a pin 98 for receiving a brake booster rod (not shown) extends radially from the second link member 96, and is utilized to transfer the motion of the brake pedal pad 88 to the brake booster rod.

The adjuster mechanism also includes a second brake pedal adjustment member 100 connected to the first adjustment member 92. The second brake pedal adjustment member 100 includes an upper portion 102 extending vertically that operatively controls a brake switch 114. The second brake pedal adjustment member 100 further includes a lower portion 104 that is generally planar, and includes an aperture 106 for operatively receiving a second brake pedal drive cable 152. The lower portion 104 of the second brake pedal adjustment member 100 is operatively attached to the U-shaped second link member 96 for the first brake pedal adjustment member 92, such as by using a pin 105. It should be appreciated that in this example, the second support member is suspended on the first support member. Preferably, the second brake pedal adjustment member 100 is made from a metal material such as zinc casting, and performs the functions of providing a cable mounting surface, connection to the first brake pedal adjustment member 92 and a switch flag for the brake switch 114.

The brake pedal adjustment means 90 also includes a screw rod 108. The screw rod 108 is operatively supported by the first brake pedal adjustment member 92, and the second brake pedal adjustment member 100. One end of the screw rod 108 is disposed through an aperture 106 in the lower portion of the second brake pedal adjustment member 100 and operatively attached to the brake pedal drive cable 152. The other end of the screw rod 108 is disposed through an aperture 109 in the second link 96 of the first brake pedal adjustment member 92. The brake pedal adjustment means 90 also includes a guide nut 110 disposed on the screw rod 108. In this example, the guide nut 110 has a generally cylindrical shape. The nut is operatively connected to the brake pedal arm 86. In this example, the brake pedal arm includes a horizontally extending channel, as shown at 112. One end of the guide nut 110 is disposed in the channel 112 in the brake pedal arm 86, to operatively transfer the rotational motion of the screw rod 108 into the linear adjustment motion for the brake pedal arm 86.

It should be appreciated that the brake pedal assembly 14 may include other components, such as the brake switch 114, mounting brackets or a stop (not shown), which are conventional and known in the art for the brake pedal assembly 14.

The manual adjustable pedal assembly 10 further includes a manual adjusting means 120, which is operated by the driver of the vehicle to simultaneously adjust the initial position of the brake pedal pad 88 and throttle pedal pad 44. The manual adjusting means 120 includes an adjusting means support bracket 122, which is mounted to a portion of the vehicle that is accessible to the vehicle operator, such as the instrument panel. In this example, the adjusting means support bracket 122 includes a front face plate 124, and a back plate 126. The front face plate 124 is preferably decorative in appearance, and may include an indicia, such as the word "PEDALS". The front face plate 124 also includes an aperture 130 for receiving the thumbwheel in a manner to be described. The front face plate 124 also includes side walls 134 extending rearwardly, and oriented vertically. The back plate 126 is positioned adjacent the each side wall of the face plate 124. Preferably, the instrument panel is sandwiched between the front face plate 124 and the back plates 126, which are secured together using a fastening means 136, such as a screw.

The manual adjusting means 120 includes a rotatable adjustment means 132 operatively supported between the side walls of the front face plate 124. In this example, the rotatable adjustment means 132 is a wheel. The outer surface of the wheel 132 has a plurality of formed ridges 138, for easier grasping by the user. It should be appreciated that the wheel 132 is positioned so that a portion of the wheel is accessible to the vehicle operator through the opening 130 in the front face plate 124.

The rotatable adjustment means 132 includes a plurality of rotary gears to transfer the rotary motion of the wheel 132 to the drive cables 152, 154. For example, the rotatable adjustment mechanism 120 includes an outer drive gear 140 disposed inside the wheel 132. The outer drive gear is of the ring type, as is known in the art, with the gear teeth radiating inwardly. The rotatable adjustment means 132 also includes a gear mounting bracket 142 operatively secured to one of the side walls extending from the front face plate 124. The gear mounting bracket 142 includes at least one radially extending gear support member 144, such as a post, for supporting a rotatable gear. In this example there are two rotatable inner gears 146, 148, one for adjusting each of the accelerator pedal and the brake pedal. The outer drive gear 140 meshingly engages the two inner gears 146, 148. The rotatable adjustment mechanism 132 also includes a drive cable mounting bracket 150 secured to one of the side walls for operatively supporting the drive cables 146, 148. For example, the upper inner gear 148 is operatively connected to the brake drive cable 152, and the lower inner gear 146 is operatively connected to the throttle drive cable 154.

The drive cables 146, 148 transfer the rotary motion of the wheel 132 to both the throttle and brake pedal adjustment means, to change the initial position of the brake or throttle pedal, respectively. One end of the brake drive cable 152 is operatively attached to the brake drive inner gear 148, and the other end is operatively attached to the brake pedal adjustment mechanism 90, as previously described. One end of the throttle pedal drive cable 154 is operatively attached to the throttle drive inner gear 146, and the other end is operatively attached to the throttle pedal adjustment mechanism 48. Each of the brake drive cable 152 and the throttle drive cable 154 includes an inner wire which is rotatably disposed within a housing.

In operation, rotation of the thumbwheel 132 causes rotation of the outer drive gear 140 in the same direction. The rotation of the outer drive gear 140 transfers the rotary motion to the inner gears 146, 148 in a complementary direction. The rotary motion of each of the inner gears 146, 148 is transferred to each of the brake drive cable 152 and throttle drive cables 154, respectively. For the brake pedal 12, the rotary motion of the brake drive cable 152 is transferred to the brake adjustment mechanism 90 to rotate the screw rod 108 in or out, depending on the direction of rotation. The rotary motion of the screw rod 108 is transferred into a linear motion by the guide nut 110, to induce the corresponding linear motion of the brake pedal arm. As a result of the movement of the brake pedal arm, the position of the brake pedal pad is adjusted either closer to the driver or farther away from the driver.

At the same time, the rotary motion of the throttle drive cable 154 is transferred to the accelerator adjuster mechanism 48 to rotate the screw rod 58 and move the guide nut up or down, depending on the direction of rotation. The rotary motion of the screw rod 58 is transferred into a linear motion by the guide nut 62, to induce the corresponding linear motion of the swing plate 28. As a result of the movement of the swing plate 28, the position of the pedal pad 44 is adjusted either closer to the driver or farther away. It should be appreciated that the dimension of the threads on either of the screw rods 58, 108 determine the rate of adjustment of each of the brake and accelerator pedals, respectively. Therefore, with similar thread dimensions the brake pedal and accelerator pedal are adjusted a corresponding amount. Alternatively, with different thread dimensions, the brake and accelerator pedals can be adjusted at different rates. It should be appreciated that in this example the cable output direction is parallel to the thumbwheel axis of rotation.

Figure 7A:
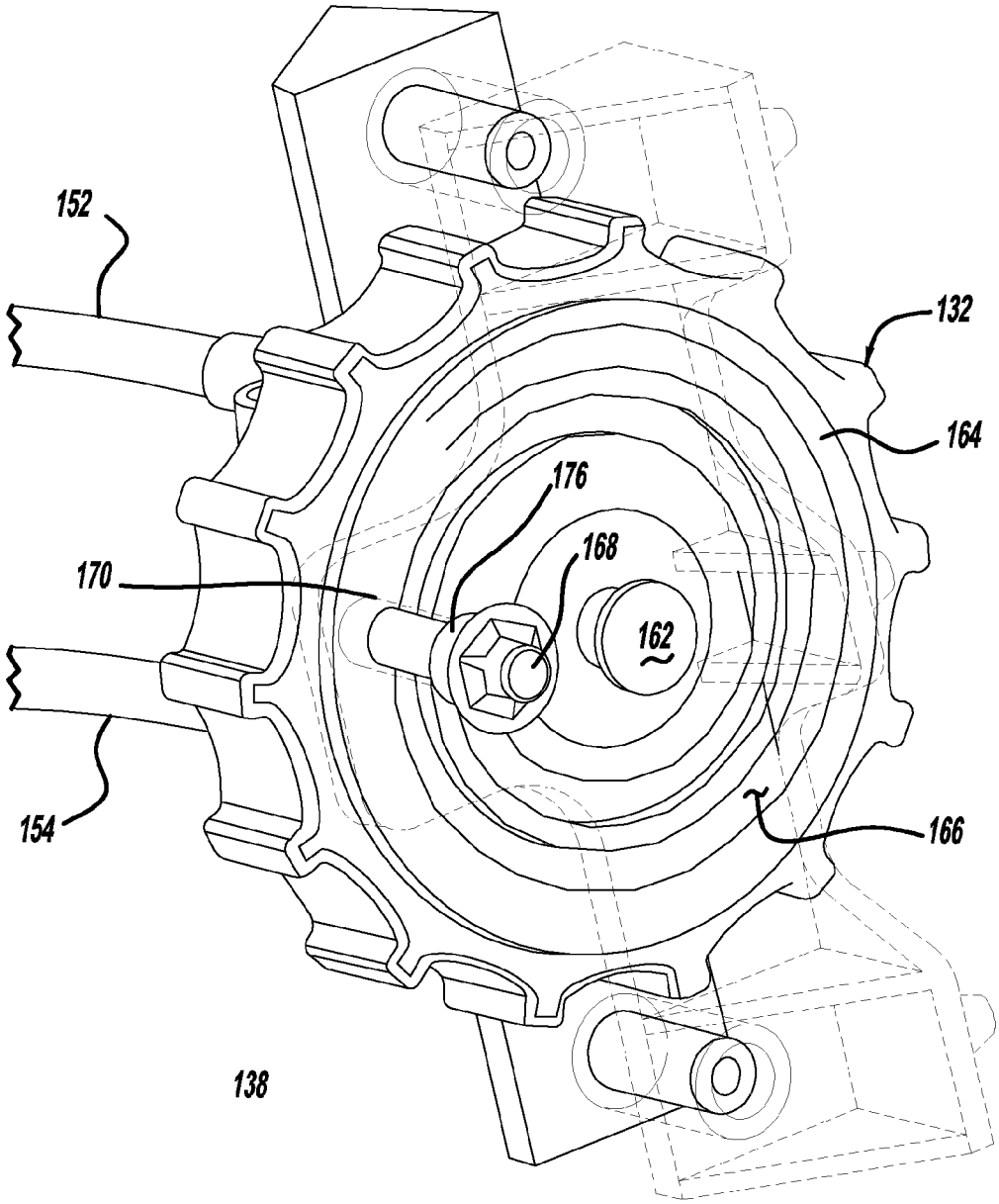
FIG. 7*a* is a perspective view of the manual adjustment mechanism in a non-adjusted position, for the manual adjustable pedal assembly of FIG. 5, according to the present invention.
Figure 7B:
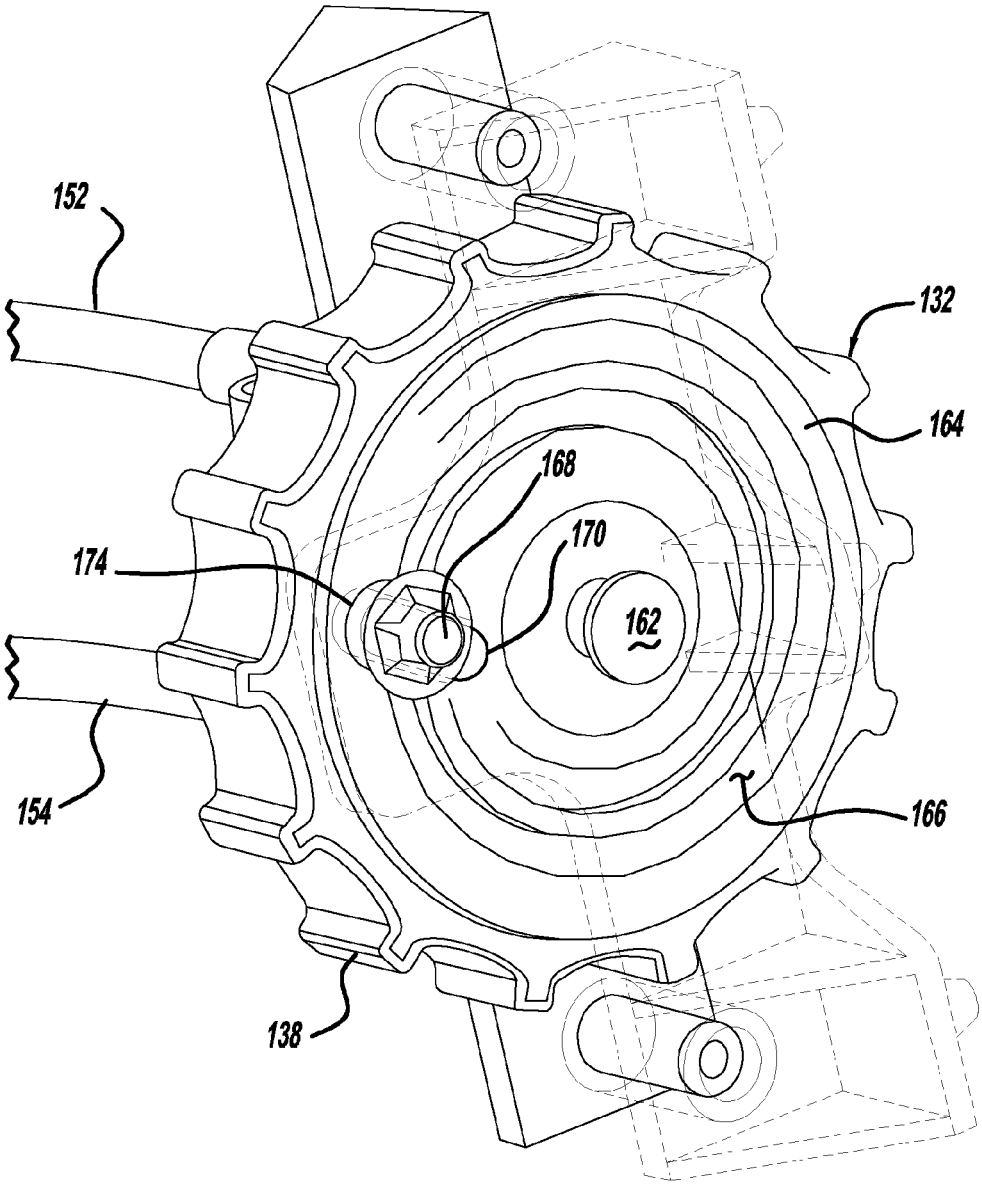
FIG. 7*b* is a perspective view of the manual adjustment mechanism in a fully adjusted position, for the manual adjustable pedal assembly of FIG. 5, according to the present invention.

In another embodiment, the wheel includes an integrally formed stopping means 160, as shown in FIGS. 7*a* and 7*b*, to limit travel of the wheel. In this embodiment, the wheel 132 is mounted on a center hub 162, and includes a solid interior surface 164. An outer side of the interior surface has an integrally formed groove or track with a spiral shape as shown at 166. This embodiment includes a follower pin 168 extending radially through a groove 170 in the side wall of the mounting bracket, with an outer end initially positioned at the outermost edge of the spiral track, as shown in FIG. 7*b* at 174. The follower pin 168 simultaneously travels through the track in the wheel and the groove in the side wall of the mounting bracket as the wheel is rotated, until the pin is stopped at the inner end of the spiral track as shown at 176. This effectively limits any further rotational movement of the wheel 132 in the same direction. The wheel 132 is rotated in the opposite direction, and the follower pin 168 returns to its initial starting position.

Figure 8B:
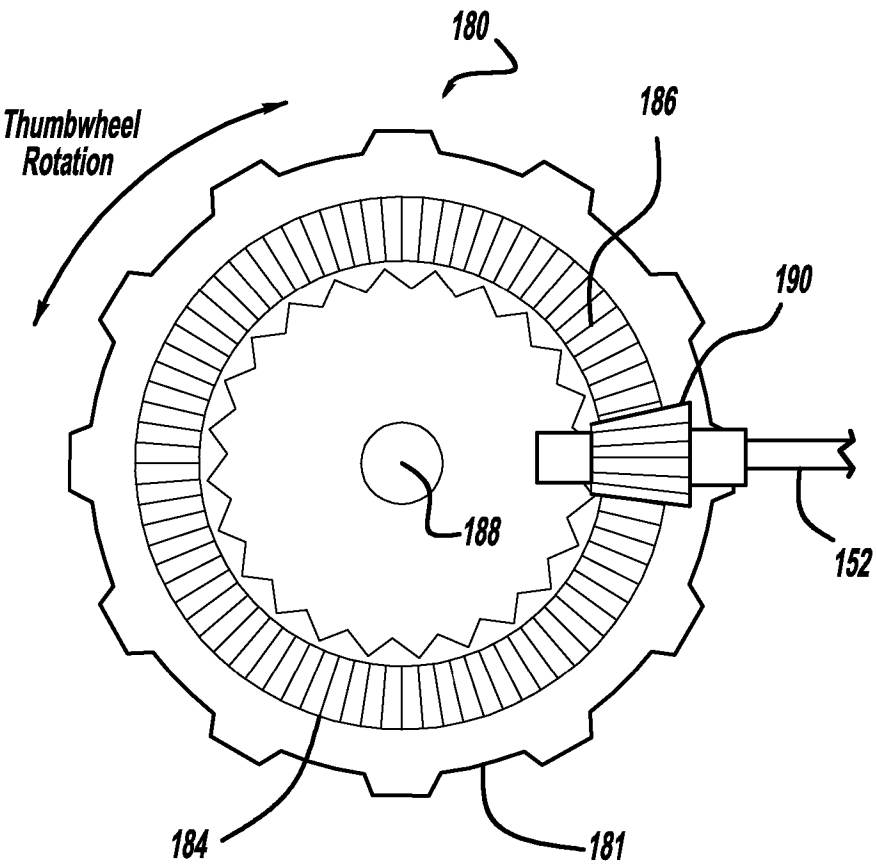
FIG. 8B is a side view of the manual adjustment mechanism of FIG. 8A, according to the present invention.
Figure 8A:
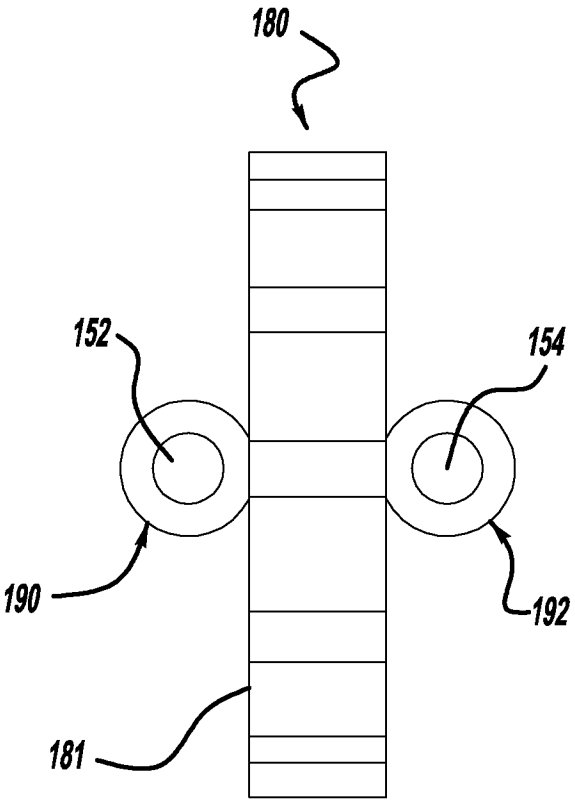
FIG. 8A is a rear elevational view of another embodiment of the manual adjustment mechanism with the cable output perpendicular to the thumbwheel axis of rotation, for the manual adjustable pedal assembly of FIG. 1, according to the present invention.

Another embodiment of the manual adjusting means is illustrated in FIGS. 8A and 8B. In this embodiment, the manual adjusting means 180 also includes a rotatable adjustment means 132 operatively supported between the walls of the front face plate 124. In this example, the rotatable adjustment means is a wheel 181. It should be appreciated that the wheel 181 is similarly positioned so that a portion of the wheel 181 is accessible to the vehicle operator, while the other portion is behind the front face plate. The wheel 181 may also include an integrally formed stopping means as previously described, to limit travel of the wheel.

The rotatable adjustment means 180 includes a plurality of gears to transfer the rotary motion of the drive wheel to the drive cable. For example, an outer ring drive gear 184 is disposed inside the wheel. The outer drive gear 184 includes a plurality of bevel teeth 186. The rotatable adjustment mechanism also includes a gear mounting bracket (not shown) operatively secured to the side walls of the support bracket. The gear mounting bracket includes a gear support, such as a post, for supporting the gears. In this example there are two second rotatable gears 190, 192, one for each of the throttle pedal and the brake pedal. Each second rotatable gear 190, 192 is positioned on opposite side of the outer gear 184, so that the outer drive gear 184 simultaneously engages each of the two second gears 190, 192. Preferably, the second gear 190, 192 is a bevel gear to operatively change the direction of rotation to be perpendicular to the wheel axis of rotation. In this example, the first inner gear 190 is operatively connected to the brake drive cable 152, and the second inner gear 192 is operatively connected to the accelerator drive cable 154. Each drive cable 152, 154 is operatively connected to the corresponding adjustment mechanisms.

In operation, rotation of the thumbwheel 132 causes rotation of the outer drive gear 184 in the same direction. The rotation of the outer drive gear 184 transfers the rotary motion to the inner gears 190, 192 in a direction perpendicular to the axis of rotation of the wheel, as show at 188. The corresponding rotary motion of each of the inner gears 190, 192 is transferred to the brake drive cable 152 and throttle drive cable 154, respectively.

Figure 9:
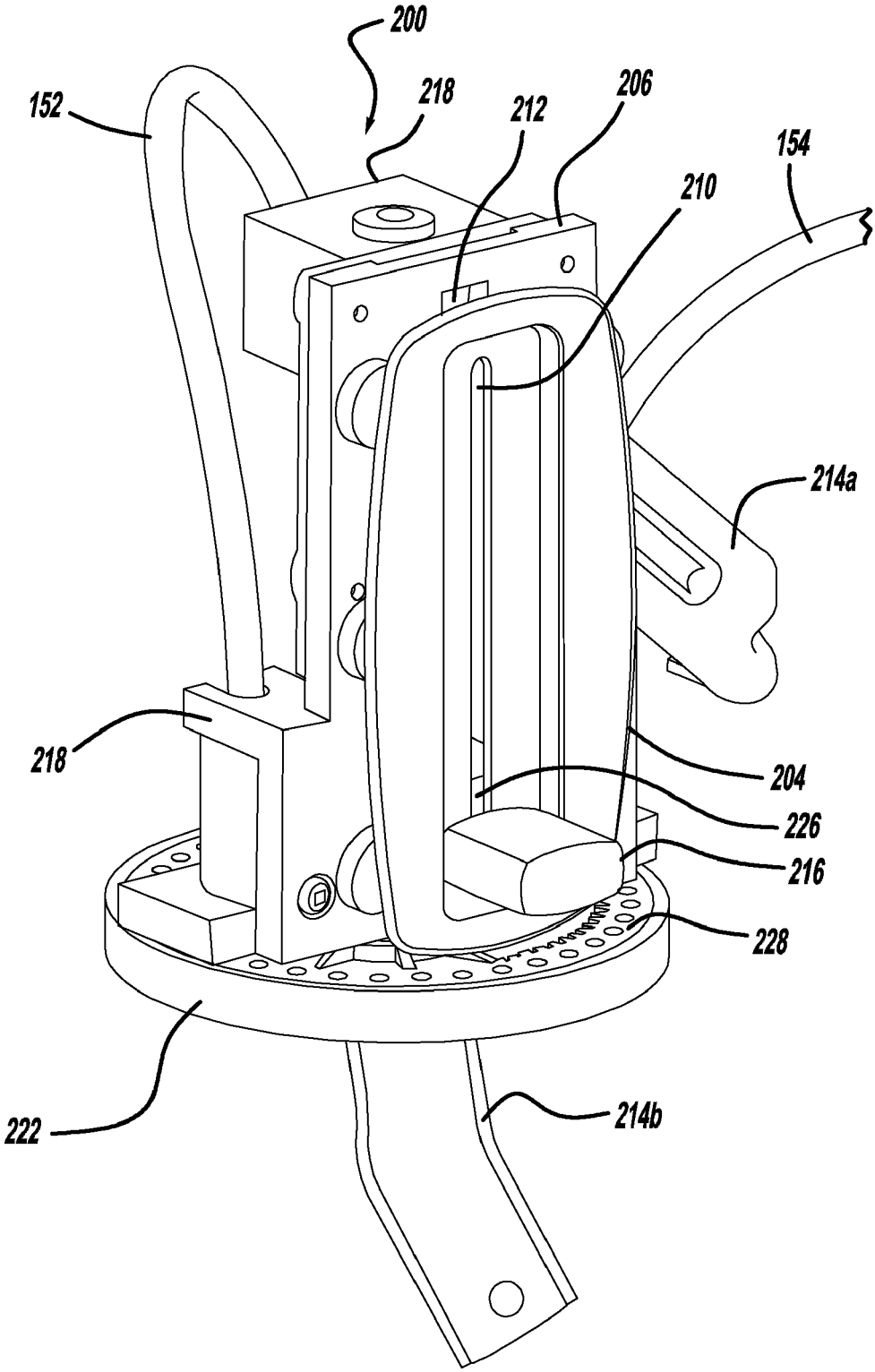
FIG. 9 is an elevational view of another embodiment of the manual adjustment mechanism for the manual adjustable pedal assembly of FIG. 1, according to the present invention.
Figure 10:
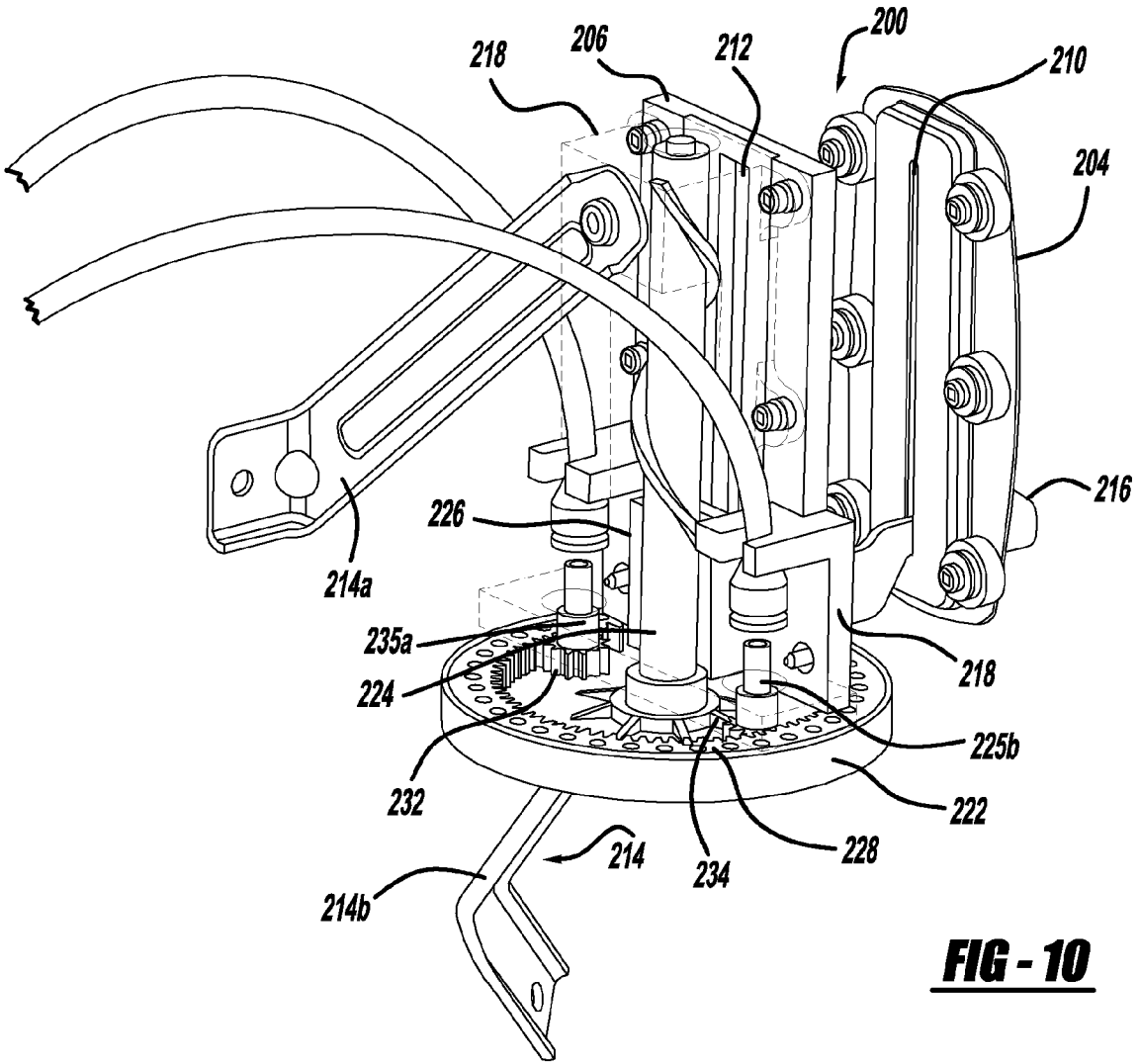
FIG. 10 is an elevational rear view of the manual adjustment mechanism of FIG. 9, according to the present invention.
Figure 11:
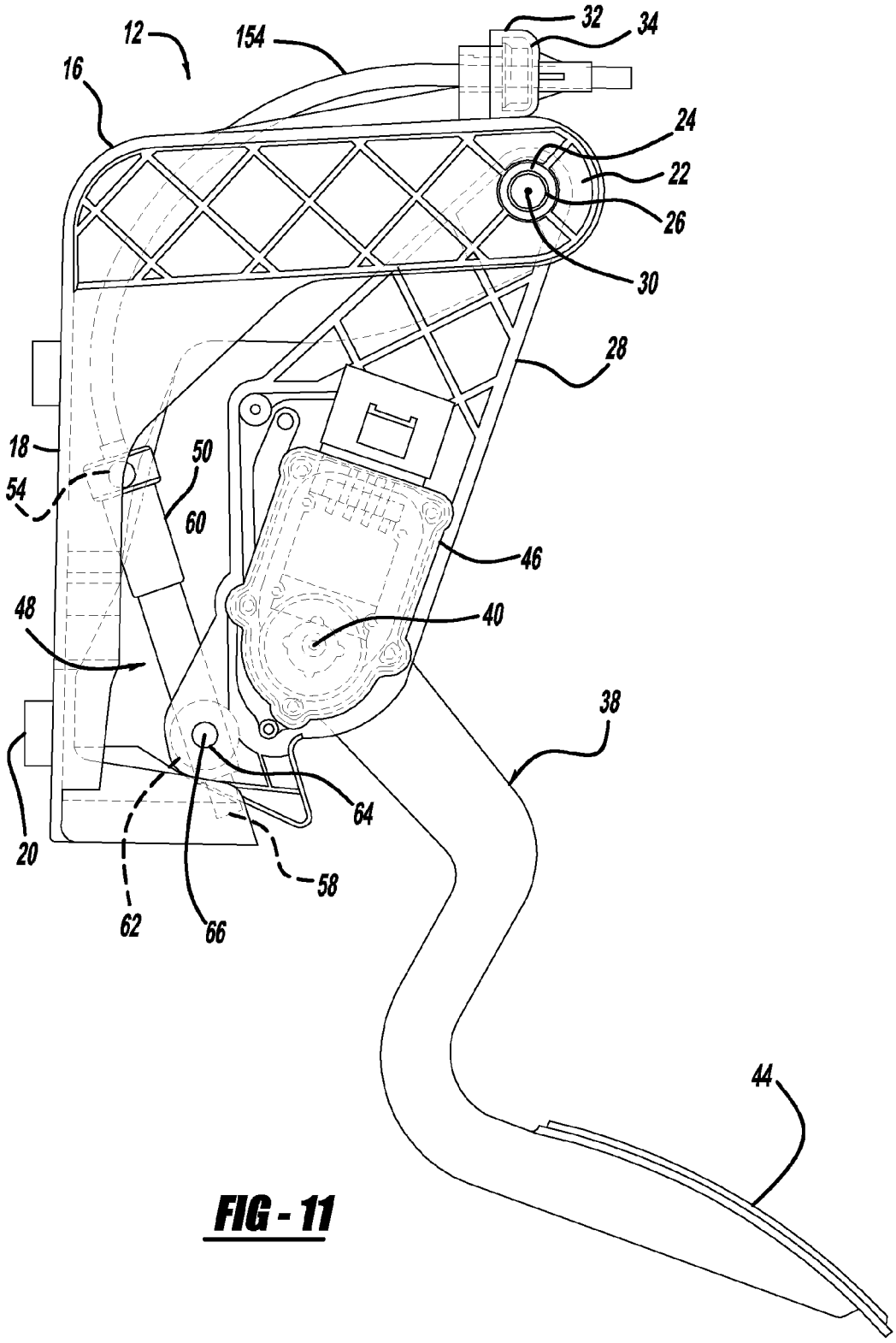
FIG. 11 is a side elevational view of the accelerator pedal for the manual adjustable pedal assembly of FIG. 1, according to the present invention.

An alternative embodiment of a manual adjusting means 200 is illustrated in FIGS. 9 and 10, for allowing the driver of the vehicle to manually adjust the position of the brake pedal pad and accelerator pedal pad. The manual adjusting means 200 includes a decorative face plate 204, which is mounted to a portion of the vehicle accessible to the vehicle operator, and a back plate 206. The front face plate is preferably decorative in appearance, and may include an indicia, such as the word "PEDALS". The front face plate also includes an aperture 210, which in this example is a slot, for receiving a lever. The back plate 206 is a generally planar member and is positioned behind the face plate 204. The back plate 206 includes a slot 212 corresponding to the slot in the front face plate 204. In this example, the slot in each of the front face plate and back plate has a vertical orientation. The instrument panel is sandwiched between the front face plate 204 and back plate 206, and secured using a fastening means (not shown), such as a screw.

The manual adjusting means 200 is supported by a support bracket 214. In this example, there is a first support bracket and a second support bracket. The first and second support brackets 214*a*, 214*b* are generally elongated, planar members. One end of each of the first and second support bracket is attached to a portion of the vehicle, such as the frame, or the instrument panel. A second end of either the first of the second support bracket 214*a*, 214*b* is attached to the manual adjusting means 200 in a manner to be described.

The manual adjusting means 200 also includes a lever 216 extending through the slots 210, 212 in the front and back plates 204, 206. A forward portion of the lever is accessible to the vehicle operator, while the rearward portion is located behind the front plate. The rearward portion of the lever is attached to a slide block, in a manner to be described.

The manual adjusting means 200 includes a housing 218 secured to the back face plate 206 using a fastening means, such as a screw. The back face plate also includes radially extending guide arms for locating each of the drive wires 152, 154. The housing is configured to cover the other components, and provide a support for the drive cables. In should be appreciated that one end of the upper attachment bracket is secured to the rear housing using a fastening means, such as a screw.

The manual adjusting means 200 further includes a horizontally oriented gear housing, which is generally circular 222, and supports a central gear shaft 224 extending radially from a center portion of the circular gear housing 222. The central gear shaft 224 is a worm gear, and it is engaged by the slide block 226 at the end of the lever. An outer ring gear 228 having a plurality of inwardly directed gear teeth is positioned within the circular gear housing 222. It should be appreciated that in this example, the circular gear housing 222 is supported by the other end of the lower support bracket 214*b*.

The manual adjusting means 200 also includes a first inner gear 232 and a second inner gear 234 operatively in communication with the outer gear 228. Each of the first inner gear 232 and second inner gear 234 is mounted on a drive shaft 235*a*, 235*b* for receiving the throttle drive cable 154 and brake drive cable 152, respectively. It should be appreciated that the throttle drive cable 154 is operatively attached to the first inner gear 232, and the brake drive cable 152 is operatively attached to the second inner gear 234. It should be appreciated that the first inner gear 232 and second inner gear 234 each rotate about a fixed axis, and the first inner gear axis and second inner gear axis are parallel to the axis of rotation of the outer gear.

In operation, linear actuation of the lever 216 operatively translates into rotation of the vertically oriented shaft 224, by transferring the linear motion of the lever into the rotary motion of the center shaft. Movement of the slide block 226 along the worm gear causes rotation of the center shaft, and the corresponding rotation of the outer gear 228. This motion transfers the rotary motion of the outer gear 228 to the inner gears 232, 234. As the inner gears 232, 234 rotate, their rotary motion is transferred to the brake drive cable 152 and throttle drive cable 154, respectively.

Advantageously, the position of each of the pedal pads moves along a predetermined path with respect to the driver depending on the desired position, while a predetermined vertical height between the floor and a point on the pedal pad is maintained. Similarly, an angular relationship between the pedal pad and the floor of the vehicle is maintained as the pedal pad moves with respect to the driver.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A manual adjustable pedal assembly comprising:

a throttle pedal assembly having a mounting bracket, a swing plate pivotally attached to said mounting bracket, a pedal arm pivotally secured to said swing plate at a second throttle pivot axis which is below said first throttle pivot axis, a pedal pad secured to a lower end of said pedal arm, and a throttle pedal adjustment mechanism for adjusting a position of said throttle pedal pad and operatively connected to said swing plate third throttle pivot axis;

a brake pedal assembly having a brake pedal mounting bracket, a brake pedal arm pivotally supported by said brake pedal mounting bracket at a first brake pedal pivot axis, a brake pedal pad operatively secured to a lower end of said brake pedal arm, and a brake pedal adjustment mechanism, for adjusting a position of said brake pedal pad;

a manual adjusting means having a support bracket, a rotatable adjustment means supported by said adjusting means support bracket, an outer ring gear disposed in a center portion of said rotatable adjustment means, a gear support member extending from said adjusting means support bracket, a first inner gear and a second inner gear operatively supported on said gear support member and operatively in communication with said outer ring gear, and an integrally formed stopping means to limit travel of said rotatable adjustment means; wherein said rotatable adjustment means is a wheel;

said integrally formed stopping means including said wheel having a solid interior surface that includes an integrally formed track with a spiral shape, a groove in a sidewall of said support bracket, a follower pin extending radially through said groove in said side wall of said support bracket, said follower pin being initially located at an outermost edge of said spiral track and dimensioned to travel through said integrally formed track and said groove in said side wall of said support bracket as said wheel is rotated, until said pin is stopped at an inner end of said spiral track to limit rotational movement of said wheel;

a throttle drive cable, wherein one end of said throttle drive cable is operatively secured to said first inner gear, and the other end of said drive cable is secured to said throttle pedal adjustment mechanism, for transmitting the rotary motion of said rotatable adjustment means to said throttle pedal adjustment mechanism; and a brake drive cable, wherein one end of said brake drive cable is operatively secured to said second inner gear, and the other end of said drive cable is secured to said brake pedal adjustment mechanism, for transmitting the rotary motion of said rotatable adjustment means to said brake pedal adjustment mechanism for simultaneous adjustment of said brake pedal and said throttle pedal.

2. The manual adjustable pedal assembly of claim 1, wherein said brake pedal adjustment mechanism includes a first support member pivotally supported by said brake support bracket at said first brake pivot axis and a second support member suspended on said first support member, such that said brake pedal arm is positioned within said first support member and said second support member, a screw rod operatively supported by said first brake support member at one end and said second brake support member at an other end, a nut slidingly disposed on said screw rod and operatively connected to said brake pedal arm.

3. The manual adjustable pedal assembly of claim 1 wherein said outer gear is disposed between said first inner gear and said second inner gear, and said first inner gear and said second inner gear are bevel gears, and said first and said second gear have an axis of rotation that is perpendicular to an axis of rotation of said rotatable adjustment means.

4. The manual adjustable pedal assembly of claim 1 further comprising:

an electronic position sensing means operatively mounted to said throttle pedal assembly at said second pivot axis, wherein movement of said pedal arm about said second pivot point produces an electronic signal proportional to a position of said pedal arm.

5. The manual adjustable pedal assembly of claim 1 further comprising:

a front face plate mounted to the vehicle, wherein said front face plate includes an aperture for receiving said rotatable adjustment means therethrough;

a side wall extending rearwardly from said front face plate, wherein said rotatable adjustment means is operatively supported between said side walls of said front face plate; and a back face plate positioned adjacent each side wall of the front face plate and secured to the front face plate.

6. The manual adjustable pedal assembly of claim 1 wherein said rotatable adjustment means is a thumbwheel.

7. The manual adjustable pedal assembly of claim 1 wherein said throttle pedal adjustment mechanism includes a trunnion pivotally supported on said throttle pedal mounting bracket, a screw rod operatively supported by said trunnion, and a guide nut slidingly disposed on said screw rod for pivotally adjusting said swing plate at a third non-fixed throttle pivot axis, which is below said first throttle pivot axis and said second throttle pivot axis.

8. A manual adjustable pedal assembly comprising:

a throttle pedal assembly having a mounting bracket with a pair of upper arms extending radially from an upper end of said mounting bracket, a swing plate pivotally supported between said upper arms at a first throttle pedal pivot axis, a pedal arm pivotally secured to said swing plate at a second throttle pivot axis which is below said first throttle pivot axis, a pedal pad secured to a lower end of said pedal arm, and a throttle pedal adjustment mechanism for adjusting a position of said throttle pedal pad, wherein said throttle pedal adjustment mechanism includes a trunnion pivotally supported on said throttle pedal mounting bracket, a screw rod operatively supported by said trunnion, and a guide nut slidingly disposed on said screw rod for pivotally adjusting said swing plate at a third non-fixed throttle pivot axis, which is below said first throttle pivot axis and said second throttle pivot axis;

a brake pedal assembly having a brake pedal mounting bracket, a brake pedal arm pivotally supported by said brake pedal mounting bracket at a first brake pedal pivot axis, a brake pedal pad operatively secured to a lower end of said brake pedal arm, and a brake pedal adjustment mechanism, wherein said brake pedal adjustment mechanism includes a first support member pivotally supported by said brake support bracket at said first brake pivot axis and a second support member suspended on said first support member, such that said brake pedal arm is positioned within said first support member and said second support member, a screw rod operatively supported by said first brake support member at one end and said second brake support member at an other end, a nut slidingly disposed on said screw rod and operatively connected to said brake pedal arm;

a manual adjusting means having a support bracket, a rotatable adjustment means supported by said adjusting means support bracket, an outer ring gear disposed in a center portion of said rotatable adjustment means, a gear support member extending from said adjusting means support bracket, a first inner gear and a second inner gear operatively supported on said support member and operatively in communication with said outer ring gear, and an integrally formed stopping means to limit travel of said rotatable adjustment means; wherein said rotatable adjustment means is a wheel;

said integrally formed stopping means including said wheel having a solid interior surface that includes an integrally formed track with a spiral shape, a groove in a sidewall of said support bracket, a follower pin extending radially through said groove in said side wall of said support bracket, said follower pin being initially located at an outermost edge of said spiral track and dimensioned to travel through said integrally formed track and said groove in said side wall of said support bracket as said wheel is rotated, until said pin is stopped at an inner end of said spiral track to limit rotational movement of said wheel;

a throttle drive cable, wherein one end of said throttle drive cable is operatively secured to said first inner gear, and the other end of said drive cable is secured to said throttle pedal adjustment mechanism, for transmitting the rotary motion of said rotatable adjustment means to said throttle pedal adjustment mechanism; and a brake drive cable, wherein one end of said brake drive cable is operatively secured to said second inner gear, and the other end of said drive cable is secured to said brake pedal adjustment mechanism, for transmitting the rotary motion of said rotatable adjustment means to said brake pedal adjustment mechanism for simultaneous adjustment of said brake pedal and said throttle pedal.

9. The manual adjustable pedal assembly of claim 8 wherein said outer gear is disposed between said first inner gear and said second inner gear, and said first inner gear and said second inner gear are bevel gears, and said first and said second gear have an axis of rotation that is perpendicular to an axis of rotation of said rotatable adjustment means.

10. The manual adjustable pedal assembly of claim 8 further comprising:

an electronic position sensing means operatively mounted to said throttle pedal assembly at said second pivot axis, wherein movement of said pedal arm about said second pivot axis produces an electronic signal proportional to a position of said pedal arm.

11. The manual adjustable pedal assembly of claim 8 further comprising:

a front face plate mounted to the vehicle, wherein said front face plate includes an aperture for receiving said rotatable adjustment means therethrough;

a side wall extending rearwardly from said front face plate, wherein said rotatable adjustment means is operatively supported between said side walls of said front face plate; and a back face plate positioned adjacent each side wall of the front face plate and secured to the front face plate.

12. The manual adjustable pedal assembly of claim 8 wherein said rotatable adjustment means is a thumbwheel.

* * * * *